US006666479B1

(12) United States Patent
Maddaleni

(10) Patent No.: US 6,666,479 B1
(45) Date of Patent: Dec. 23, 2003

(54) ICE SKATE SCABBARD

(76) Inventor: Elizabeth M. Maddaleni, 4 Hammersmith Dr., Saugus, MA (US) 01906

( * ) Notice: Subject to any disclaimer, the term of this patent is extended or adjusted under 35 U.S.C. 154(b) by 0 days.

(21) Appl. No.: 10/006,632

(22) Filed: Nov. 8, 2001

(51) Int. Cl.[7] ..... A63C 3/12; A45F 5/00
(52) U.S. Cl. ..... 280/825; 294/137
(58) Field of Search ..... 280/825, 809; 224/232, 235; 24/71 SK, 69 SK; 383/95; 294/137; 36/135, 7.5, 7.6, 59 R

(56) References Cited

U.S. PATENT DOCUMENTS

| | | | | | |
|---|---|---|---|---|---|
| 1,310,137 | A | * | 7/1919 | Sadowsky | 280/825 |
| 1,930,820 | A | * | 10/1933 | Johnson | 280/825 |
| 2,651,853 | A | * | 9/1953 | Lewis | 36/111 |
| 3,040,451 | A | * | 6/1962 | Hilkemeyer | 36/7.5 |
| 3,263,348 | A | * | 8/1966 | Cohen et al. | 36/117.3 |
| 3,399,470 | A | * | 9/1968 | Schofield | 36/7.1 R |
| D258,604 | S | * | 3/1981 | Sholl | D21/225 |
| 4,382,615 | A | * | 5/1983 | Gronborg et al. | 280/825 |
| 4,546,999 | A | | 10/1985 | Lehr | |
| 4,616,428 | A | * | 10/1986 | Leger | 36/7.1 R |
| 5,303,955 | A | * | 4/1994 | Zurnamer | 280/825 |
| 5,522,621 | A | * | 6/1996 | Schneider | 280/825 |
| 5,787,607 | A | * | 8/1998 | Schurch | 36/7.1 R |
| 5,822,884 | A | * | 10/1998 | Roeder | 36/7.1 R |
| 5,833,270 | A | * | 11/1998 | Hubshman | 280/825 |
| 5,983,526 | A | * | 11/1999 | Pawlik et al. | 36/7.1 R |

* cited by examiner

*Primary Examiner*—Brian L. Johnson
*Assistant Examiner*—G B Klebe
(74) *Attorney, Agent, or Firm*—Joseph R. Birkner

(57) ABSTRACT

A scabbard for receiving a blade of an ice skate. The scabbard has a pouch with a top opening for receiving the blade of the ice skate and is constructed from various material layers to protect a user from being cut by the sharp edges of the blade when the ice skate is carried and to protect the blade when the ice skate is being stored. In addition to preventing puncture of the pouch, a friction enhancing material is disposed on an outer portion of flexible material of the pouch along a bottom of the pouch and extending from a first end to a second end of the pouch, which also allows a skater to safely walk with the scabbard attached about the blade. The pouch has a drawstring means for adjustably fitting the pouch, about the blade of the ice skate. This permits the scabbard to be used on various sizes of ice skates without modification. Securing means such as, a cord lock, for slidably adjusting the size of the pouch is disposed on an exposed cord member portion near a first end and a second end of the cord member so that when the blade is inserted into the pouch, the scabbard is releasably secured about the ice skate blade. To facilitate evaporation of moisture and to reduce drying time, ventilation ports may be included on the outer portion of flexible material of the pouch.

14 Claims, 2 Drawing Sheets

ICE SKATE SCABBARD

FIELD OF THE INVENTION

This invention relates generally to ice skate blade covers and guards. More particularly, the present invention relates to an ice skate scabbard which is readily attachable to the blade of various sizes of ice skates.

BACKGROUND OF THE INVENTION

Ice skate blade guards are typically made of stiff hard rubber and are stretched over a blade of an ice skate. The guards are used to protect the blade of the skate from damage as the skater walks over the ground to the ice skating area. They are also used to protect the skater from injury when carrying the skates. Such blade guards are bulky and can not be readily stored in the skater's pocket, and, if they are left on the ground, they are often lost or stolen. Furthermore, the stiff hard rubber guards allow water to accumulate in the blade track which causes the blade to rust, discolor or become dull. Also, the dimensions of the rubber guards limits their use for covering different blade sizes, requiring a skater to purchase various guards for each size skate. This is a problem particularly for children who rapidly outgrow their skates.

Some ice skate blade covers utilize two pieces made of plastic material with fastening means, such as springs or straps and clips which fasten the skate blade guards to the ice skate blades. These are cumbersome, dangerous to walk on, inconvenient to use and costly to purchase.

Another type of ice skate blade cover is a bag-like cover which is soft and which has an elastic member completely enclosed in a hem extending about an opening in the bag. In use, the bag is stretched over the blade to cover it. Such a blade cover is widely used by skaters who skate on indoor rinks and do not typically walk on the ground, rather they remove the bag cover immediately prior to use and do so, adjacent the ice. However, many skaters often do walk, even for a small distance, on their covered skate blades to the ice. The bag, is often cut through by the sharp blade edges and becomes damaged. Another problem with this design is that it can not fit a wide variety of skate sizes without modification; also the elastic member, after prolonged use, loses it's elasticity and the bag no longer fits over the blade snugly and often falls off leaving the sharp blade edges dangerously exposed. To adapt such a design to fit over a larger or over a smaller size blade, a user typically must cut the hem open and sever the elastic member. Next, they must stretch the mutilated bag and the elastic member, often to extreme limits, and then physically tie the ends of the damaged elastic member together in an attempt to fit the bag onto a slightly different blade size. Unless this is done carefully, the bag typically does not properly fit the particular blade. Later, when another size blade requires covering, the process must be repeated at the risk of weakening the materials and doing further damage to the bag. This is an undesirable, frustrating and very time consuming way to cover a blade.

A practical ice skate scabbard, for which there is an unfulfilled need, wherein the ice skate scabbard is capable of being selectively usable for a size range of ice skate blade applications, without modification, and one which protects the blade and the skater from cuts and one which prevents damage to the ice skate scabbard is not available.

U.S. Pat. No. 4,546,999 to Lehr shows a flexible skateguard with a pouch of flexible material which attaches to an opening between the ice skate shoe and the blade of an ice skate with hook and loop type fasteners. A disadvantage of this design is that the skateguard attachment relies on an opening which may be inaccessible or limited on a particular ice skate design. Another disadvantage is that no provision is provided for size adjustment without modification and the skateguard can not be used for covering the blades of other sizes of ice skate blades other than a particular ice skate blade for which it was specifically designed. A user would have to purchase additional skateguards for each and every ice skate which is costly.

None of the above prior art devices disclose an ice skate scabbard which has a pouch having a top opening for receiving the blade of the ice skate; layers of materials which protect the blade and prevent puncture by the sharp blade edges and prevent injury to the user; drawstring means for adjustably fitting the pouch about the blade of various sizes of ice skates so that the ice skate blade is protectively covered when the ice skate is carried by a user and when the ice skate is stored; means for securing the drawstring means so that the pouch is releasably secured about the blade of the ice skate; and an ice skate scabbard which is simple in design and is easy to use.

In view of the above mentioned problems and limitations associated with conventional ice skate blade covers and guards, it was recognized by the present inventor that there is an unfulfilled need for an improved ice skate scabbard which fits various skate sizes without modification, is simple in design, practical, fun to use and is economically manufactured and which overcomes the disadvantages of the prior art devices.

SUMMARY OF THE INVENTION

It is therefore an object of this invention to provide a new and improved scabbard for receiving a blade of an ice skate which is conveniently usable for covering the blades of various ice skate sizes which avoids the aforementioned problems of prior art devices.

It is an object of the instant invention to provide a scabbard which may be manufactured from readily available materials by conventional manufacturing processes.

It is a further object of this invention to provide a scabbard that is simple in design, simple to manufacture, low in cost and fun to use.

It is a further object of this invention to provide a scabbard which has a pouch having a top opening for receiving the blade of the ice skate with layers of materials which protect the blade and prevent puncture by the sharp blade edges and prevent injury to the user.

It is another object of this invention to provide a scabbard which provides a drawstring means for adjustably fitting the pouch about the blade of various sizes of ice skates so that the ice skate blade is protectively, covered when the ice skate is carried by a user and when the ice skate a is stored.

It is a still a further object of this invention to provide a scabbard which has means for securing the drawstring means so that the pouch is releasably secured about the blade of the ice skate.

Further objects will become apparent from the following description and claims.

This invention results from the realization that there is a great need for an improved ice skate scabbard. The resulting invention provides a user the capability of conveniently being able to cover the blade of an ice skate without the need to purchase separate scabbards for each size of ice skate.

The above and the other objects are achieved in accordance with the present invention, which, according to a first aspect, provides a scabbard for receiving a blade of an ice skate, which has a pouch having a top opening for receiving the blade of the ice skate; an inner portion of moisture absorbent material; an outer portion of flexible material and a friction enhancing material disposed on the outer portion along a bottom of the pouch and extending from a first end to a second end of the pouch and extending through the top opening into the pouch interior at each end and drawstring means for adjustably fitting the pouch about the blade of the ice skate so that the ice skate blade is protectively covered when the ice skate is carried by a user and when the ice skate is stored.

The second aspect is a special case of the first aspect of this invention with additional features such as an intermediate portion of cushioning material disposed between the inner portion of moisture absorbent material of the pouch and the outer portion of flexible material of the pouch. Also, the drawstring means comprises a hem, extending about the top opening of the pouch; a cord member, disposed within the hem with a portion of the cord member including a first end and a second end of the cord member being exposed, and a cord lock, for slidably adjusting the size of the pouch, disposed on the exposed cord member portion near the first end and the second end of the cord member so that when the blade is inserted into the pouch, the scabbard is releasably secured about the ice skate blade. Ventilation ports are included to facilitate evaporation of moisture.

According to a third aspect of the invention, disclosed is a method for using a scabbard for an ice skate.

DETAILED DESCRIPTION OF PREFERRED EMBODIMENTS

Figure 1:
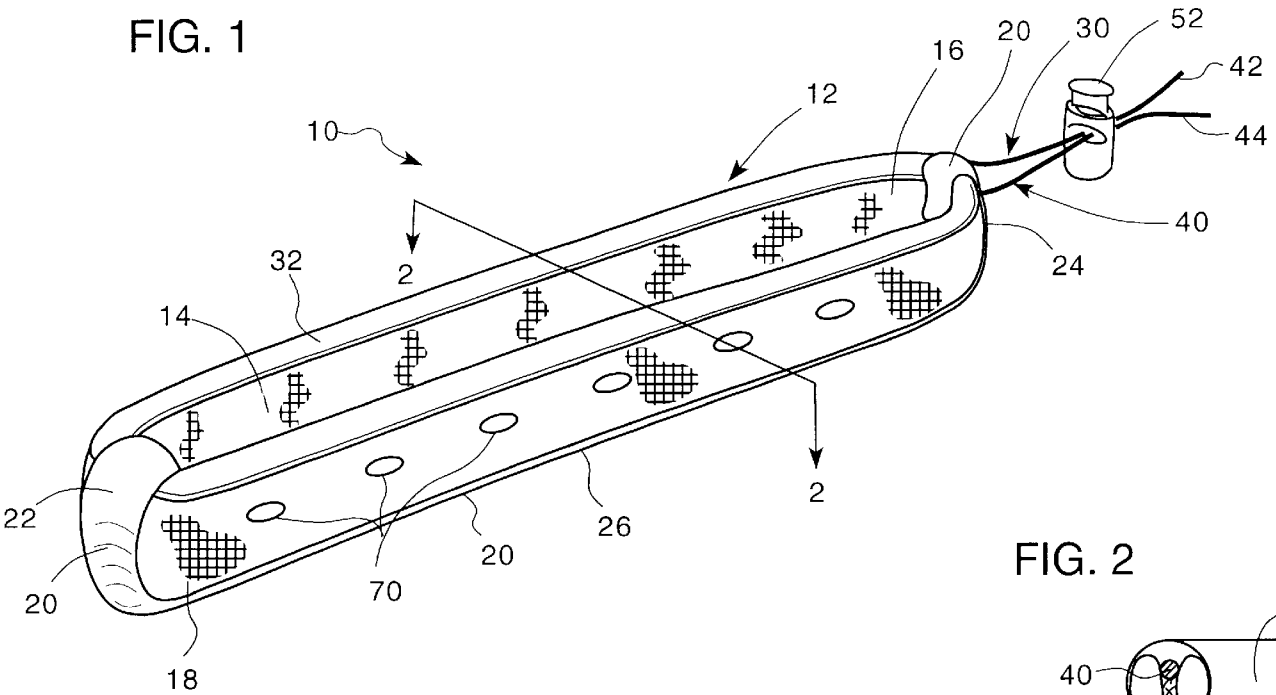
FIG. 1 is a right side perspective view of a preferred embodiment of an ice skate scabbard of the instant invention.

Looking more particularly to the drawings, there is shown in FIG. 1 a preferred embodiment of a scabbard, which is generally indicated at 10, for receiving a blade of an ice skate, according to a preferred embodiment of the present invention. It is understood that reference herein to the blade and to the ice skate, regardless of the size of the blade or of the ice skate, for convenience, are referred to as blade 82 and ice skate 80.

Figure 3:
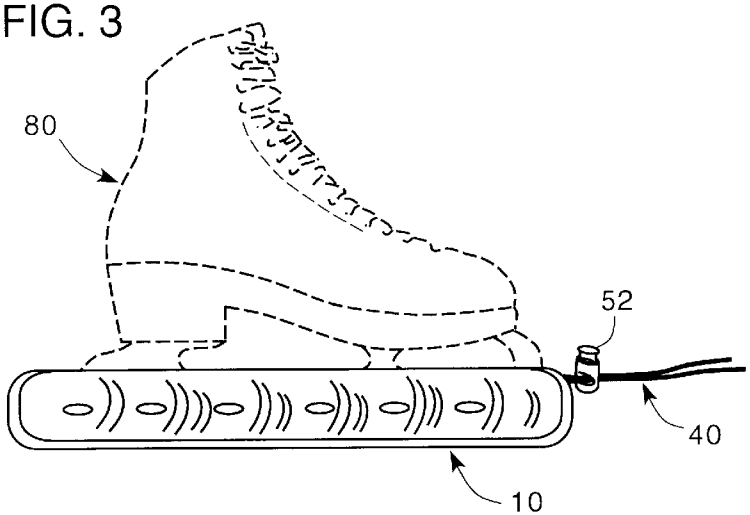
FIG. 3 is right side elevation view of a preferred embodiment of the ice skate scabbard of FIG. 1 shown attached to a blade of a small size ice skate shown in phantom.
Figure 4:
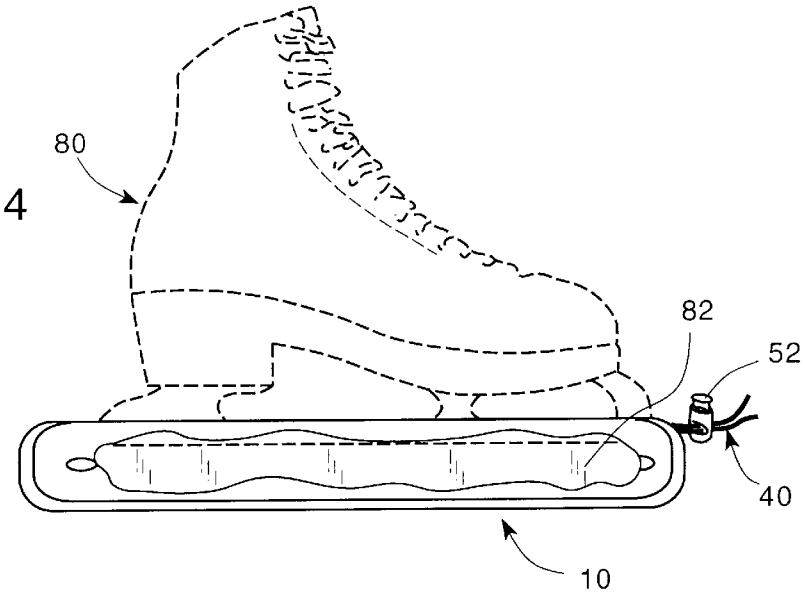
FIG. 4 is right side elevation view of a preferred embodiment of the ice skate scabbard of FIG. 1 shown expanded and attached to a blade of a large size ice skate shown in phantom.

As seen in FIG. 1, the scabbard 10, has a pouch 12 having a top opening 14 for receiving the blade 82 of the ice skate 80 shown in FIG. 3 and in FIG. 4. The pouch 12 has several layers of material namely, an inner portion 16 of moisture absorbent material; an outer portion 18 of flexible material and a friction enhancing material 20 disposed on the outer portion 18 along a bottom 26 of the pouch 12 and extending from a first end 22 to a second end 24 of the pouch 12 and extending through the top opening into the pouch interior at each end. The material layers protect a user from being cut by the sharp edges of the blade 82 when the ice skate 80 is carried and protect the blade 82 when the ice skate 80 is being stored. In addition to preventing puncture of the pouch 12, the friction enhancing material 20 also allows the skater to safely walk with the scabbard 10 attached about the blade 82. Pouch 12 has a drawstring means 30 for adjustably fitting the pouch 12 about the blade 82 of the ice skate 80. This permits the scabbard 10 to be used on various sizes of ice skates without modification as shown in FIG. 3 and in FIG. 4. The drawstring means 30 comprises a hem 32, extending about the top opening 14 of the pouch 12 with a cord member 40, disposed within the hem 32 with a portion of the cord member 40 including a first end 42 and a second end 44 of the cord member 40 being exposed. The drawstring means 30 preferably has securing means such as a cord lock 52, for slidably adjusting the size of the pouch 12. The cord lock 52 is disposed on an exposed portion of the cord member 40 near the first end 42 and the second end 44 of the cord member 40 so that when the blade 82 is inserted into the pouch 12, the scabbard 10 is releasably secured about the blade 82 of the ice skate 80. It is understood that the cord member 40 may be secured by tying the ends 42,44 without the need for the cord lock 52, but the invention will work better with the preferred cord lock 52.

Figure 2:
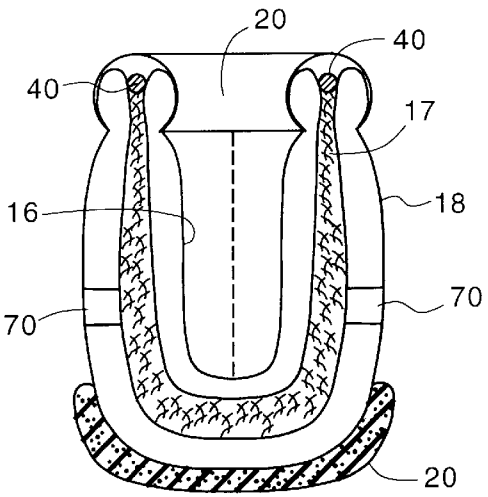
FIG. 2 is an enlarged cross sectional view of the ice skate scabbard of FIG. 1 showing the construction details taken along the line 2—2 of FIG. 1.

FIG. 2 is an enlarged cross sectional view of the ice skate scabbard of FIG. 1 showing the construction details taken along the line 2—2 of FIG. 1.

The pouch 12 is fabricated from a material blank which is folded and is sewn together. The pouch 12 is flexible so that it is size expandable and adaptable for use on various sizes and styles of ice skates, without modification. The pouch 12 may also be folded and readily stored in a pocket of a skater. The inner portion 16 of moisture absorbent material of the pouch 12 is fabricated from a material having wicking properties chosen from the group consisting of terry cloth, sponge, cotton and flannel so that moisture from the blade 82 is absorbed and directed away from the blade 82 thereby keeping it dry. The outer portion 18 of flexible material of the pouch 12 is fabricated from a material chosen from the group consisting of fleece, wool, flannel, nylon, denim, mesh fabric and cotton. If a mesh material is used for the outer portion 18 of flexible material of the pouch 12, adequate ventilation is provided by the mesh to dissipate moisture from the pouch 12; however, it was recognized by the inventor, that a plurality of ventilation ports 70 may be strategically disposed on the outer portion 18, especially when materials other than mesh are used, to further enhance moisture migration. The friction enhancing material 20 of the pouch 12 is rubber, preferably a soft rubber. Also, although not necessary for operation, for further protection, preferably, the scabbard 10 may also include an intermediate portion 17 of cushioning material disposed between the inner portion 16 of moisture absorbent material and the outer portion 18 of flexible material of the pouch 12. When used, the cushioning material may be a polyester fiber fill. The cord member 40 may be fabricated from natural or synthetic materials such as cotton or plastic. The cord lock 52 may be made of plastic or metal from two portions, an upper portion and a lower portion with a spring biasing the upper portion and the lower portion toward each other with a cord member receiving opening therein.

A method for protectively covering a blade 82 of an ice skate 80 when the ice skate 80 is carried by a user and when the ice skate 80 is stored is accomplished with the instant invention. The drawstring means 30 and the pouch 12 of the scabbard 10 are adjusted to the size of the blade 82 to be covered. This is done by unlocking the cord lock 52 from the cord member 40 and sliding it along the cord member 40 and allowing the pouch 12 to slideably expand or contract, as needed, along the length of the cord member 40 until the desired blade 82 size is achieved. The blade 82 of the ice skate 80 is inserted into the top opening 14 of the pouch 12. The cord lock 52 is slid along the cord member 40 to secure the drawstring means 30 and the pouch 12 about the blade 82 of the ice skate 80. FIG. 3 and FIG. 4 show the scabbard 10 attached to different size blades without the need for modification.

According to the teachings of the instant invention disclosed herein, the applicant fabricated a working prototype from readily available materials by sewing, and has actually reduced the invention to practice with favorable results. Surprisingly, the applicant discovered that the prototype was capable of fitting blades of different sizes of ice skates with no difficulty.

Surprisingly, the instant invention provides an added advantage and recognizes a problem and adequately and completely addresses an unfulfilled need, in that the instant invention, in the manner disclosed, in effect, provides a convenient apparatus which allows a user to protect the blades of ice skates without modification or the limitations of the prior art devices and provides the desired above mentioned advantages and benefits to a user.

It is understood that the scabbard 10 may be constructed in a wide variety of sizes, patterns and style variations. One practical advantage of the invention is that it provides a convenient, practical, low cost, scabbard 10, which allows a user to conveniently cover the blades of ice skates without the need to purchase blade covers for each pair of ice skates, thereby saving time and money. Another advantage of the invention, is that it can readily fit into a pocket of a skater thereby eliminating the potential for losing or misplacing the scabbard 10 when ice skating. Still a further advantage of the instant invention is that a skater may walk on the blade 82 of the ice skate 80 when the scabbard 10 is installed without the possibility of puncturing the scabbard 10. Another advantage of the invention is that the scabbard 10 may be used to wipe the ice particles and moisture off the blade 82 prior to placement of the blade 82 into the pouch 12 of the scabbard 10; the material properties of the scabbard 10 facilitate drying. A further advantage of the invention is that the instant invention is designed for ease of manufacture by standard methods and by using readily available materials.

Of course, a wide variety of further uses and advantages of the present invention will become apparent to one skilled in the art. Also, one skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed:

1. A scabbard for receiving a blade of an ice skate, said scabbard comprising:

a pouch having a first end and a second end, each said end being closed; a top opening for receiving the blade of the ice skate; an inner portion of moisture absorbent material; an outer portion of flexible material and a friction enhancing material disposed on said outer portion along a bottom of said pouch and extending from said first end to said second end of said pouch through the top opening into an interior of said pouch with said friction enhancing material covering said inner portion and said outer portion of said pouch at a convergence thereof and means for adjustably fitting said pouch about the blade of the ice skate; said fitting means disposed along the top opening and contained therebetween said inner portion and said outer portion and inclusive therebetween said friction enhancing material at said first end and at said second end.

2. The scabbard of claim 1 wherein said fitting means comprises a hem, extending about the top opening of said pouch; a cord member, disposed within said hem with a portion of said cord member including a first end and a second end of said cord member being exposed.

3. The scabbard of claim 2 wherein said fitting means further comprising means for securing said fitting means so that said pouch of said scabbard is releasably secured about the blade of the ice skate.

4. The scabbard of claim 3 wherein said securing means includes a cord lock disposed on said exposed cord member portion for slidably adjusting and for adjustably securing the size of said pouch when said first end and said second end of said cord member each pass therethrough said cord lock allowing said first end and said second end of said cord member to be selectively tied into a knot to prevent loss of said cord lock.

5. The scabbard of claim 4 wherein said pouch is flexible so that said pouch is size expandable and adaptable for use on various sizes of ice skates without modification.

6. The scabbard of claim 5 wherein said inner portion of moisture absorbent material of said pouch is fabricated from a material having wicking properties chosen from the group consisting of terry cloth, sponge, cotton and flannel.

7. The scabbard of claim 6 wherein said outer portion of flexible material of said pouch is fabricated from a material chosen from the group consisting of fleece, wool, flannel, nylon, denim, mesh fabric and cotton.

8. The scabbard of claim 7 wherein said friction enhancing material of said pouch is rubber.

9. The scabbard of claim 8 wherein said outer portion of flexible material further comprising a plurality of ventilation ports disposed thereon wherein said plurality of ventilation ports extending therethrough said outer portion without extending to the interior of said scabbard.

10. The scabbard of claim 9 further comprising an intermediate portion of cushioning material disposed between said inner portion of moisture absorbent material of said pouch and said outer portion of flexible material of said pouch.

11. The scabbard of claim 10 wherein said cushioning material is a polyester fiber fill.

12. An ice skate scabbard comprising:

a pouch having a first end and a second end, each said end being closed; a top opening for receiving the blade of an ice skate; an inner portion of moisture absorbent material; an outer portion of flexible material and a friction enhancing material disposed on said outer portion along a bottom of said pouch and extending from said first end to said second end of said pouch through the top opening into an interior of said pouch with said friction enhancing material covering said inner portion and said outer portion of said pouch at a convergence thereof; an intermediate portion of cushioning material disposed between said inner portion of moisture absorbent material of said pouch and said outer portion of flexible material of said pouch and means for adjustably fitting said pouch about the blade of the ice skate; said fitting means disposed along the top opening and contained therebetween said inner portion and said outer portion and on said intermediate portion of cushioning material and inclusive therebetween said friction enhancing material at said first end and at said second end so that the ice skate blade is protectively covered when the ice skate is carried by a user and when the ice skate is stored, wherein said fitting means comprises a hem, extending about the top opening of said pouch; a cord member, disposed within said hem with a portion of said cord member including a first end and a second end of said cord member being exposed, and a cord lock, for slidably adjusting and for adjustably securing the size of said pouch when said first end and said second end of said cord member each pass therethrough said cord lock allowing said first end and said second end of said cord member to be selectively tied into a knot to prevent loss of said cord lock and said cord lock disposed on said exposed cord member portion near said first end and said second end of said cord member so that when the blade is inserted into the top opening of said pouch said ice skate scabbard is releasably secured about the ice skate blade.

13. The scabbard of claim 12 wherein said outer portion of flexible material further comprising a plurality of ventilation ports disposed thereon.

14. A method for protectively covering a blade of an ice skate when the ice skate is carried by a user and when the ice skate is stored, comprising the steps of:

providing a scabbard having a pouch with a first end and a second end, each said end being closed; a top opening for receiving the blade of the ice skate; an inner portion of moisture absorbent material; an outer portion of flexible material and a friction enhancing material disposed on said outer portion along a bottom of said pouch and extending from said first end to said second end of said pouch through the top opening into an interior of said pouch with said friction enhancing material covering said inner portion and said outer portion of said pouch at a convergence thereof; means for adjustably fitting said pouch to the blade of the ice skate; and means for securing said fitting means so that said pouch of said scabbard is releasably secured to the blade of the ice skate;

adjusting said fitting means and said pouch to the size of the blade to be covered;

inserting the blade of the ice skate into the top opening of said pouch and utilizing said securing means to secure said fitting means and said pouch about the blade of the ice skate.

* * * * *